US006052925A

United States Patent [19]

Reiners

[11] Patent Number: 6,052,925

[45] Date of Patent: Apr. 25, 2000

[54] METHOD FOR DETERMINING THE FRONT AND REAR AXLE WEIGHT OF AN EARTH MOVING MACHINE

[75] Inventor: Eric A. Reiners, Saint Charles, Ill.

[73] Assignee: Caterpillar Inc., Peoria, Ill.

[21] Appl. No.: 08/996,006

[22] Filed: Dec. 22, 1997

[51] Int. Cl.[7] ..... E02F 5/00; A01B 63/02

[52] U.S. Cl. ..... 37/348; 172/2; 172/4.5; 172/7; 701/50

[58] Field of Search ..... 37/348, 382, 414, 37/415; 172/7, 10, 11, 12, 4.5, 2; 701/50

[56] References Cited

U.S. PATENT DOCUMENTS

| | | | |
|---|---|---|---|
| 4,081,996 | 4/1978 | Jennings et al. | 73/141 A |
| 5,321,637 | 6/1994 | Anderson et al. | 364/567 |
| 5,929,389 | 7/1999 | Keuper | 177/141 |
| 5,995,888 | 11/1999 | Hagenbuch | 701/35 |

OTHER PUBLICATIONS

System and Method for Automatic Bucket Loading Using Crowd Factors, Docket No. 96–263, Filed Jan. 6, 1997, Application No. 8/779262.

System and Method for Automatic Bucket Loading Using Force Vectors, Docket No. 96–279, Filed Jan. 6, 1997, Application No. 8/779193.

*Primary Examiner*—Eileen Dunn Lillis
*Assistant Examiner*—Gary S. Hartmann
*Attorney, Agent, or Firm*—W. Bryan McPherson

[57] ABSTRACT

A method for determining the front and rear axle weights of an earth moving machine. The method includes determining the weight of a portion of the earth moving machine, and the forces acting on the lift cylinder pin, lift arm pin, and the tilt cylinder pin. The axle weights are determined in response to the above mentioned weights and forces.

3 Claims, 4 Drawing Sheets

METHOD FOR DETERMINING THE FRONT AND REAR AXLE WEIGHT OF AN EARTH MOVING MACHINE

TECHNICAL FIELD

The present invention relates generally to a drive train of an earth moving machine, and more particularly, to a method for determining front and rear axle weights of an earth moving machine.

BACKGROUND ART

Earth moving machines such as front wheel loaders are used generally for digging operations and for transferring bulk material from a stock pile onto transport vehicles such as trucks or railroad cars. In such machine loading applications, the front and rear axle may experience excessive torque which will effect the life of the axle. If accurate front and rear axle weights may be determined then accurate front and rear driveshaft torques can be calculated. Accurate front and rear driveshaft torques calculations will enable the cumulative axle life to be determined. The ability to determine a cumulative axle life would enable prognostic information to be provided to the operator of the machine regarding how much life was left on the loader axles. Knowing the remaining life would enable the operator to schedule an axle overhaul or replacement and thus greatly reduce downtime due to axle failure.

The present invention is directed to overcome one or more of the problems set forth above.

DISCLOSURE OF THE INVENTION

In one aspect of the present invention, a method for dynamically determining the weight of a front and rear axle of an earth moving machine is disclosed. The earth moving machine includes a work implement and a the front and rear axle. In addition, the earth moving machine has a lift cylinder, lift arm assembly, and a tilt cylinder. The method comprises the steps of determining a weight of a portion of the machine, and determining the forces acting on the cylinder pins. The front and rear axle weight are determined in response to the weight and the cylinder pin forces.

BEST MODE FOR CARRYING OUT THE INVENTION

Figure 1:
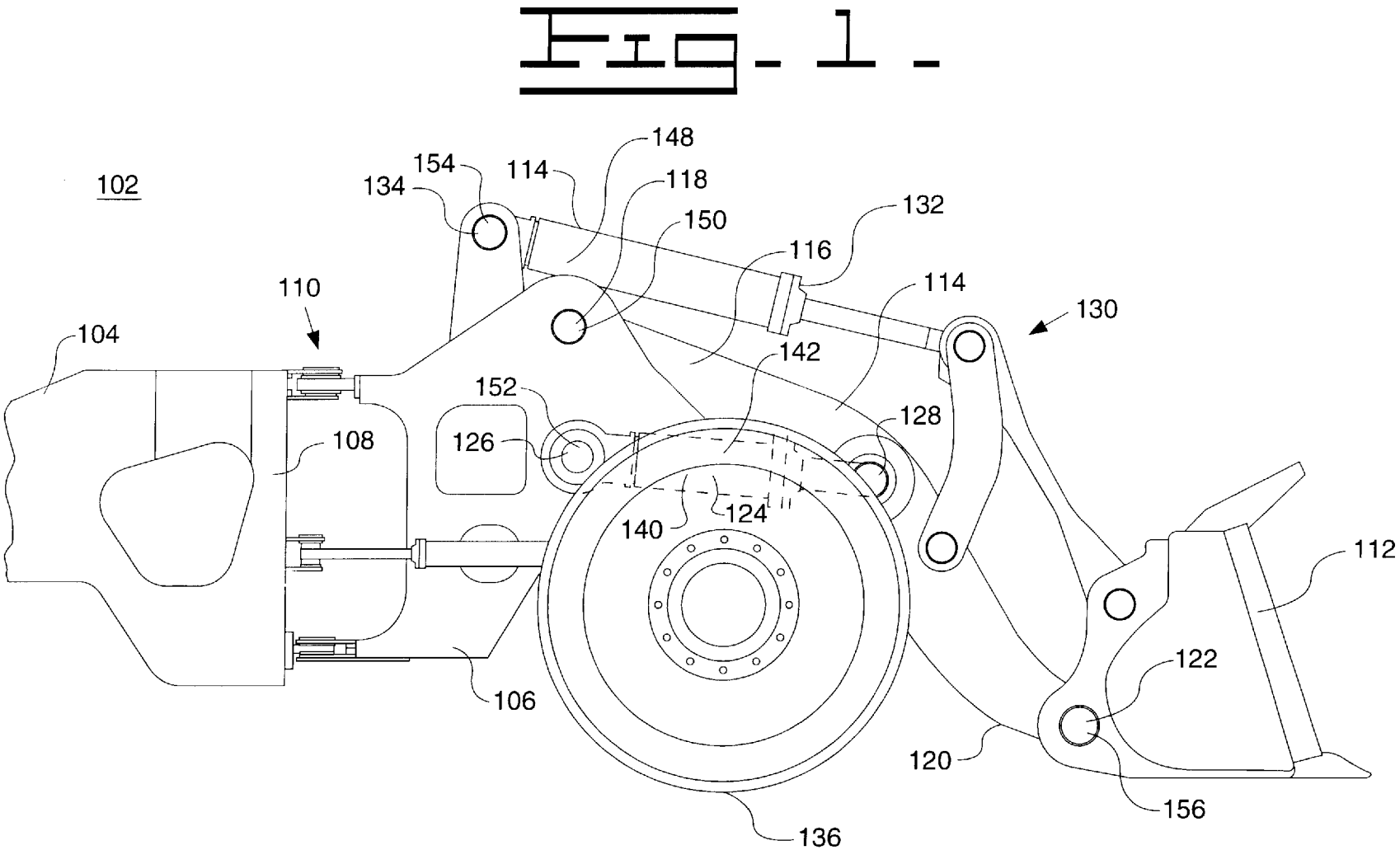
FIG. 1 is an illustration of a front end portion of a wheel loader.

The present invention provides a method and apparatus for dynamically determining the front and rear axle weights for an earth moving machine such as a wheel loader, as shown in FIG. 1. The machine 102 has a rear frame assembly 104 that mounts to a front frame assembly 106. The front frame assembly 106 is also referred to as the non-engine end frame assembly. The rear frame assembly is also referred to as the engine end frame assembly. The front frame assembly 106 is mounted to the rear frame assembly 104 through an articulation hitch that is generally at 110. A work implement

112 is mounted to the front frame assembly 106. In the illustrated embodiment, the work implement 112 is a bucket and is utilized to load various types of material. The work implement 112 is mounted to the front frame assembly 106 by a lift arm assembly 114. The first end portion 116 of the lift arm assembly 114 is connected to the front frame assembly 106 by a frame pin assembly 118. The frame pin assembly 118 includes a lift arm pin 150, commonly referred to as the A pin. The frame pin assembly 118 enables the lift arm assembly 114 to pivotally move with respect to the front frame assembly 106 along a generally vertical plane. The second end portion 120 of the lift arm assembly 114 is connected to the work implement 112 by a bucket pin assembly 122. The bucket pin assembly 122 includes a bucket pin 156, commonly known as the B pin. The lift arm assembly 114 is moved along the vertical plane by at least one lift cylinder 124. If two lift cylinders 124 are used, they are positioned on opposite sides of the lift arm assembly 114. Each lift cylinder 124 has a first end portion pivotally mounted to the front frame assembly 106 by a lift arm pin assembly 126 and a second end portion mounted to the lift arm assembly 114 by a lift bucket pin assembly 128. The lift arm pin assembly 126 includes a lift cylinder pin 152, commonly referred to as the Y pin. Extension and retraction of the lift cylinders 124 in a well known manner causes movement of the lift arm assembly 114 with respect to the front frame assembly 106.

The work implement 112 is rotated about the bucket pin assembly 122 by a tilt link arrangement shown generally at 130. At least one tilt cylinder 132 is positioned between the front frame assembly 106 and the tilt link arrangement 130. A first end portion of the tilt cylinder 132 is pivotally mounted to the front frame assembly 106 by a tilt pin assembly 134. The tilt pin assembly 134 includes a tilt cylinder pin 154, commonly referred to as the G pin. The tilt cylinder 132 extends forwardly and has a second end portion that is mounted to the tilt link arrangement 130. Extension and retraction of the tilt cylinder 132 will cause movement of the work implement 112 relative to the lift arm assembly 114 along the vertical plane.

A lift cylinder displacement sensing means 140 is used to determine the amount of cylinder extension in the lift cylinder 124, and responsively generates a lift cylinder displacement signal. In the preferred embodiment the lift cylinder displacement sensing means includes a rotary sensor sensing the rotation of one of the lift arm pins 150 from which the extension of the lift cylinders 124 can be derived. A lift cylinder pressure sensing means 142, such as a pressure transducer, senses the hydraulic pressure in both ends of the lift cylinders 124 and responsively generates lift cylinder pressure signals. In addition a tilt cylinder displacement sensing means 144 is used to determine the amount of cylinder extension in the tilt cylinder 132, and responsively generates a tilt cylinder displacement signal. A tilt cylinder pressure sensing means 148, such as a pressure transducer, senses the hydraulic pressure in both ends of the tilt cylinders 132 and responsively generates a tilt cylinder pressure signals.

Figure 2:
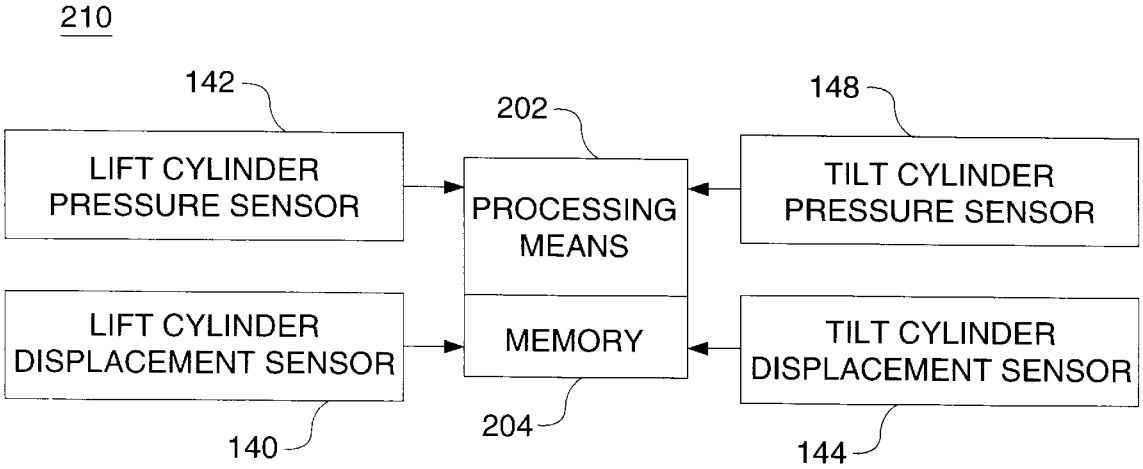
FIG. 2 is an illustration of one embodiment of the present invention.

One embodiment of the present invention is encompassed by the system 210 illustrated in FIG. 2. A processing means 202, such as a microprocessor, receives the lift cylinder pressure signals, lift cylinder displacement signal, tilt cylinder displacement signal, and tilt cylinder pressure signal, and responsively determines the front and rear axle weights of the machine 102.

Figure 3:
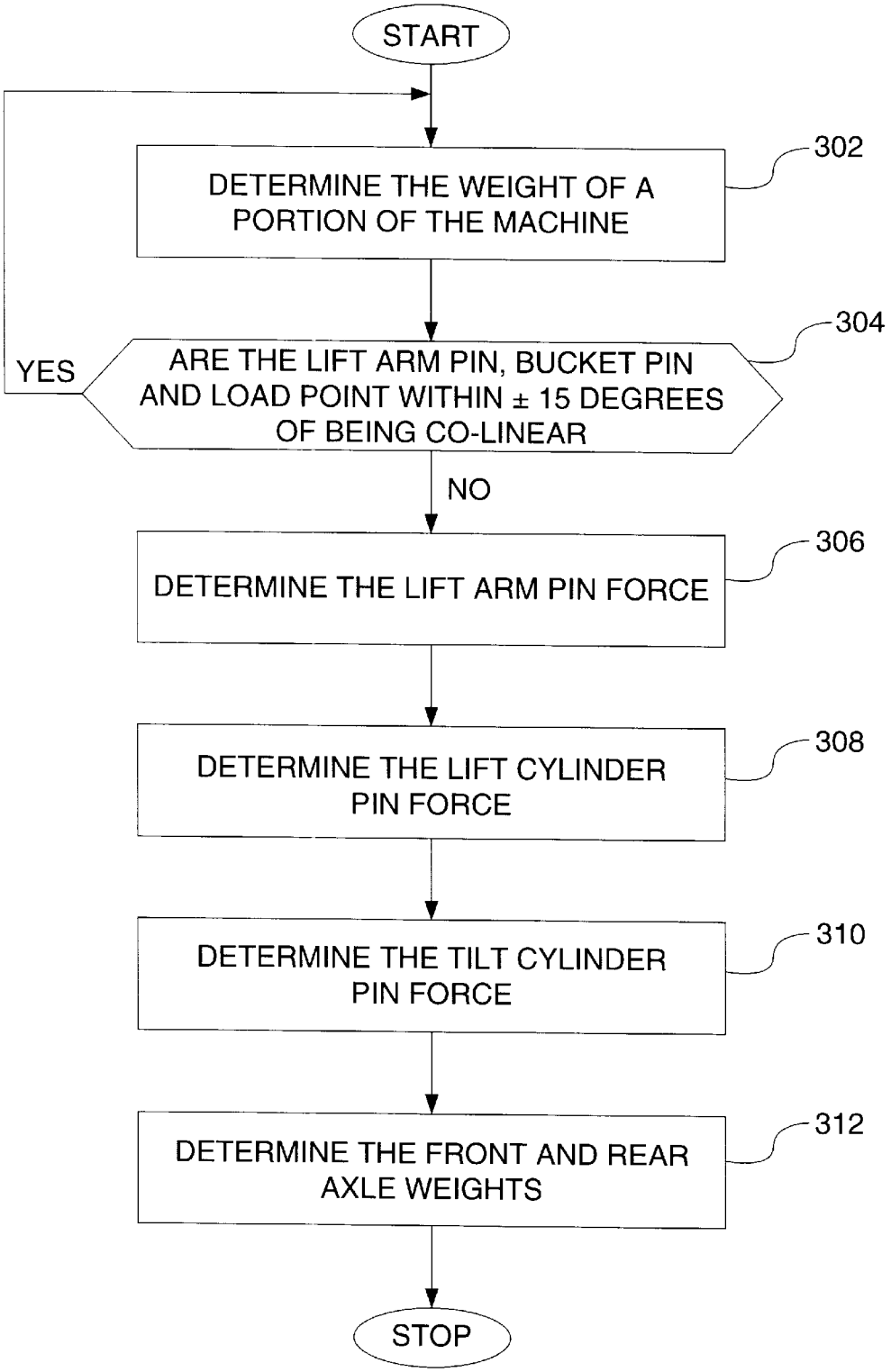
FIG. 3 is a flow diagram illustrating one embodiment of the method of the present invention.

A method for determining the front and rear axle weights is illustrated in the flow diagram of FIG. 3. In the first control block 302 the weight of a portion of the machine 102 is determined. In the preferred embodiment, the weights needed for the calculation include the weights of the front and rear frame assembly 106, 104, the lift cylinder pin 152, lift arm pin 150, and tilt cylinder pin 154. The weight and location of the center of gravity of the front frame assembly 106 and the rear frame assembly 104 are predetermined. In addition, the weights of the lift cylinder pin 152, lift arm pin 150, and tilt cylinder pin 154 are predetermined. In the preferred embodiment the predetermined weights are stored in a memory 204 within the microprocessor 202, as shown in FIG. 2, corresponding to a configuration file which is developed for each machine 102.

Referring again to FIG. 3, in a second control block 304, the lift cylinder and tilt cylinder displacement signals are used to determine whether the lift arm pin 150, the bucket pin 156, and the load point are within +/−15 degrees of being colinear. The load point is defined as being a point four inches behind the cutting edge in the center of the bucket 112. The load point is the point on the bucket 112 where the load forces are translated to. The load point is an SAE defined point used to define the location of tipping force loads. The axle weight calculations of the present invention are not valid when the colinear condition exist. Therefore, when the colinear condition exist, the method aborts the current calculations and returns to the beginning of the method. The aspect of determining whether a lift arm pin 150, bucket pin 156, and load point are within +/−15 degrees of being colinear are considered to be within the level of ordinary skill in the art and will not be set forth herein.

In a second, third, and fourth control block 306, 308, 310 the lift cylinder pin force acting on the lift cylinder pin 154, the lift arm pin force acting on the lift arm pin 150, and the tilt cylinder pin force acting on the tilt cylinder pin 152 are determined. The aforementioned determinations of the lift cylinder, lift arm, and tilt cylinder pin forces involves translation of the corresponding forces acting through the tilt link arrangement 130, the lift arm assembly 114, and the work implement 112. The determinations include sensing the displacement of the lift and tilt cylinders, 124, 132. In addition, the forces acting on the bucket 112, e.g., load forces from digging or lifting, are determined and used to determine the lift cylinder, lift arm, and tilt cylinder pin forces. The load forces resulting from digging or lifting may be determined by analyzing the lift and tilt pressure signals. The precise computations of the lift cylinder, lift arm, and tilt cylinder pin forces, are dependent on the particular machine configuration, but are considered to be within the level of ordinary skill in the art and will not be set forth herein.

In a sixth control block 312 the front and rear axle weights are determined. The front and rear axle weights are determined in response to the weight of the front frame assembly 106, and the rear frame assembly 104, the weights of the lift cylinder pin 154, lift arm pin 150, and tilt cylinder pin 152, and the forces acting on the lift cylinder pin 154, lift arm pin 150, and tilt cylinder pin 152.

In the preferred embodiment the front and rear axle weights are determined using the following equations:

$$\Sigma M_{FA}=W_{NEEF}(X_{FA}-X_{NEEF})-(Y_Y-W_Y)(X_{FA}-X_Y)-Y_X(Y_Y-Y_{FA})+A_X(Y_A-Y_{FA})+(A_Y+W_A)(X_{FA}-X_A)-(G_Y-W_G)(X_{FA}-X_G)-G_X(Y_G-Y_{FA})+W_{EEF}(X_{FA}-X_{EEF})-R_A(X_{FA}-X_{RA})$$

SO THAT $$R_A=\frac{W_{NEEF}(X_{FA}-X_{NEEF})-(Y_Y-W_Y)(X_{FA}-X_Y)-Y_X(Y_Y-Y_{FA})+A_X(Y_A-Y_{FA})+(A_Y+W_A)(X_{FA}-X_A)-(G_Y-W_G)(X_{FA}-X_G)-G_X(Y_G-Y_{FA})+W_{EEF}(X_{FA}-X_{EEF})}{(X_{FA}-X_{RA})}$$

$$\Sigma M_{RA}=F_A(X_{FA}-X_{RA})-W_{NEEF}(X_{NEEF}-X_{RA})-W_{EEF}(X_{EEF}-X_{RA})+(Y_Y-W_Y)(X_Y-X_{RA})-Y_X(Y_Y-Y_{RA})-(A_Y+W_A)(X_A-X_{RA})+A_X(Y_A-Y_{RA})-G_X(Y_G-Y_{RA})(G_Y-W_G)(X_G-X_{RA})$$

SO THAT $$F_A=\frac{W_{NEEF}(X_{NEEF}-X_{RA})+W_{EEF}(X_{EEF}-X_{RA})-(Y_Y-W_Y)(X_Y-X_{RA})+Y_X(Y_Y-Y_{RA})+A_Y+W_A)(X_A-X_{RA})-A_X(Y_A-Y_{RA})+(G_X(Y_G-Y_{RA})-(G_Y-W_G)(X_G-X_{RA})}{(X_{FA}-X_{RA})}$$

WHERE $\Sigma M_{FA}$=The sum of the forces acting on the front axle $\Sigma M_{RA}$=The sum of the forces acting on the rear axle $F_A$=The reaction force at the front axle $A_{X,\ Y}$=The horizontal and vertical force at the A pin (or Lift Arm Pin)

$G_{X,\ Y}$=The horizontal and vertical force at the G pin (or Lift Cylinder Pin)

$W_{NEEP}$=The weight of the non-engine end frame (or front frame assembly), at the center of gravity of the non-engine end frame $X_{(LOCATION)}$=The horizontal location of the designated point $Y_{(LOCATION)}$=The vertical location of the designated point $R_A$=The reaction force at the rear axle $Y_{X,\ Y}$=The horizontal and vertical force at the Y pin (or Tilt Cylinder Pin)

Figure 4:
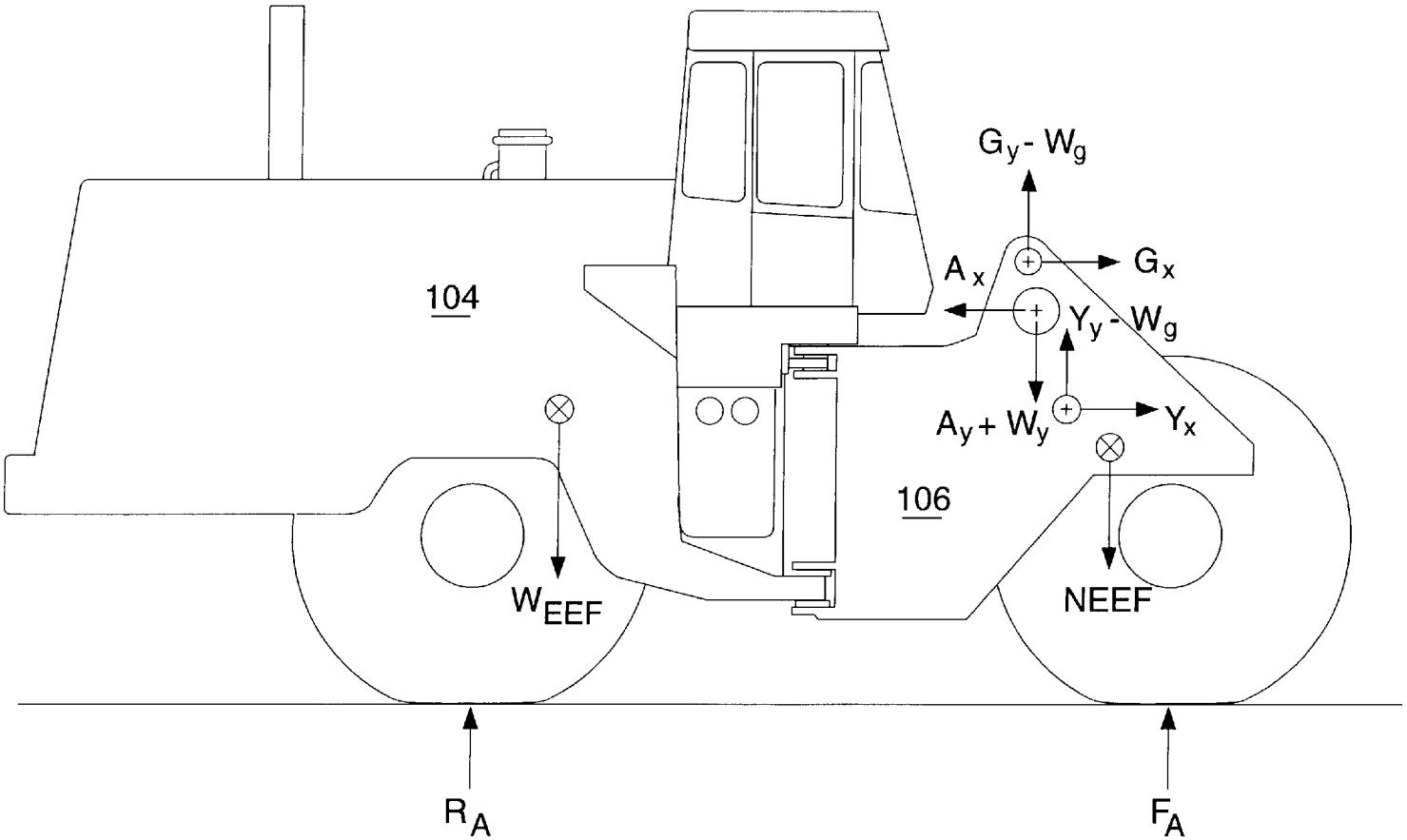
FIG. 4 is an illustration of the location of forces relative to the machine.

$W_{A,\ G,\ Y}$=The weight of the A, G, and & Y pin $W_{EEF}$=The weight of the engine end frame (or rear frame assembly), at the center of gravity of the engine end frame FIG. 4 illustrates the location of the forces with regard to the machine 102. For purposes of clarity, the machine 102 illustrated in FIG. 4 does not show the work implement 112, or the linkage assemblies and associated cylinders.

The result of these calculations is the determination of the front and rear axle weights. Once the front and rear axle weights are determined, the method is concluded. Alternatively, the method could return to the beginning to continuously repeat the determination.

Industrial Applicability

With reference to the drawings and in operation, the present invention is adapted to provide a method for determining the front and rear axle weights of an earth moving machine. The method includes determining the weight of a portion of the earth moving machine, and the forces acting on the lift cylinder pin 152, lift arm pin 150, and the tilt cylinder pin 154. The axle weights are determined in response to the above mentioned weights and forces.

In the preferred embodiment, the axle weight calculations are dynamically performed while the earth moving machine is operating. The lift and tilt cylinder displacements are determined, along with the bucket forces that are occurring. The cylinder displacement and bucket force information is used to determine the pin forces. Based on the dynamically determined pin forces, and the weights stored in the configuration file, the processing means 202 dynamically determines the front and rear axle weights of the machine 102.

The resulting front and rear axle weight calculations may be used to determine an axle damage index, or axle life calculations. Axle life calculations may be used to provide prognostic information to the operator, whether on-board or off-board, of the machine regarding how much longer the axles will be useful. Knowing the remaining axle life, the operator may schedule an axle overhaul, thereby reducing unplanned downtime due to axle failure. In addition, an axle damage index number would enable an analysis of an operators digging technique.

Other aspects, objects, advantages and uses of the present invention can be obtained from a study of the drawings, disclosures and appended claims.

What is claimed is:

1. A method for dynamically determining the weight of a front and rear axle of an earth moving machine having a work implement, the front and rear axle being connected to a front and rear tire respectively, and the front and rear tire being in contact with a land site, the earth moving machine having a lift cylinder, lift arm assembly, and a tilt cylinder, the lift cylinder having a lift cylinder pin connecting the lift cylinder to the earth moving machine, the tilt cylinder having a tilt cylinder pin connecting the tilt cylinder to the earth moving machine, and the lift arm assembly having a lift arm pin connecting the lift arm assembly to the earth moving machine, comprising the steps of:

determining a weight of a portion of the machine;

determining a lift cylinder pin force acting on said lift cylinder pin;

determining a tilt cylinder pin force acting on said tilt cylinder pin;

determining a lift arm pin force acting on said lift arm pin; and, determining said front and rear axle weight in response to said weight, said lift cylinder force, said lift arm force, and said tilt cylinder force.

2. A method as set forth in claim 1, wherein the step of determining a weight of a portion of the machine includes the steps of:

determining a weight of the front frame assembly of the machine;

determining a weight of the rear frame assembly of the machine;

determining a weight of the lift cylinder pin;

determining a weight of the lift arm pin; and determining a weight of the tilt cylinder pin.

3. A method as set forth in claim 2, further comprising the steps of:

storing a configuration file for said weight of a portion of the machine, said configuration file including said front frame assembly weight, said rear frame assembly weight, said lift cylinder pin weight, said lift arm pin weight, and said tilt cylinder pin weight.

* * * * *